US007503745B2

(12) United States Patent
Whitehouse et al.

(10) Patent No.: US 7,503,745 B2
(45) Date of Patent: Mar. 17, 2009

(54) PUMP ASSEMBLY FOR CHILLED BEVERAGE DISPENSER

(75) Inventors: Bradley S. Whitehouse, Pewee Valley, KY (US); Thomas J. Pfeifer, Louisville, KY (US)

(73) Assignee: Grindmaster Corporation, Louisville, KY (US)

( * ) Notice: Subject to any disclaimer, the term of this patent is extended or adjusted under 35 U.S.C. 154(b) by 478 days.

(21) Appl. No.: 11/420,033

(22) Filed: May 24, 2006

(65) Prior Publication Data

US 2007/0065312 A1 Mar. 22, 2007

Related U.S. Application Data

(60) Provisional application No. 60/718,467, filed on Sep. 19, 2005.

(51) Int. Cl.
*B67D 5/56* (2006.01)
*B67D 5/48* (2006.01)
*F04D 29/44* (2006.01)

(52) U.S. Cl. ..... 415/203; 222/129.1; 222/383.2

(58) Field of Classification Search ..... 415/88, 415/89, 185, 186, 203, 206, 208.2, 208.3, 415/211.2; 222/129.1–129.4, 372, 383.2, 222/410

See application file for complete search history.

(56) References Cited

U.S. PATENT DOCUMENTS 2,840,996 A 7/1958 Steinhorst et al.
3,119,531 A * 1/1964 Jacobs ..... 222/318
3,920,163 A * 11/1975 Brown ..... 222/190
4,537,332 A * 8/1985 Brown et al. ..... 222/190
4,696,417 A * 9/1987 Ugolini ..... 222/146.6
5,209,069 A 5/1993 Newnan
6,318,247 B1 * 11/2001 Di Nunzio et al. ..... 99/348
6,817,207 B2 11/2004 Bonato et al.
7,213,965 B2 * 5/2007 Daniels, Jr. ..... 366/192
7,270,156 B2 * 9/2007 Beesley et al. ..... 141/82

OTHER PUBLICATIONS

International Searching Authority/US, International Search Report and Written Opinion for PCT/US06/20458, Aug. 1, 2007.

* cited by examiner

*Primary Examiner*—Edward Look
*Assistant Examiner*—Sean J Younger
(74) *Attorney, Agent, or Firm*—Stites & Harbison, PLLC; David W. Nagle, Jr.

(57) ABSTRACT

A pump assembly for a chilled beverage dispenser includes an axle oriented in a substantially vertical orientation at a predetermined location along a bottom wall surface of the dispenser bowl; an impeller which rotates about an axis defined by the axle; an inner pump shell that fits over the axle and defines an internal cavity for enclosing the impeller without impeding rotation of the impeller; and an outer pump shell that fits over and engages the lower pump shell, with a cavity being defined and maintained between the inner pump shell and the outer pump shell. As the bladed impeller rotates, beverage is drawn into the pump assembly along the bottom wall surface of the dispenser bowl, and is also discharged along the bottom wall surface of the dispenser bowl, thus providing maximum agitation of the beverage.

18 Claims, 4 Drawing Sheets

FIG. 2
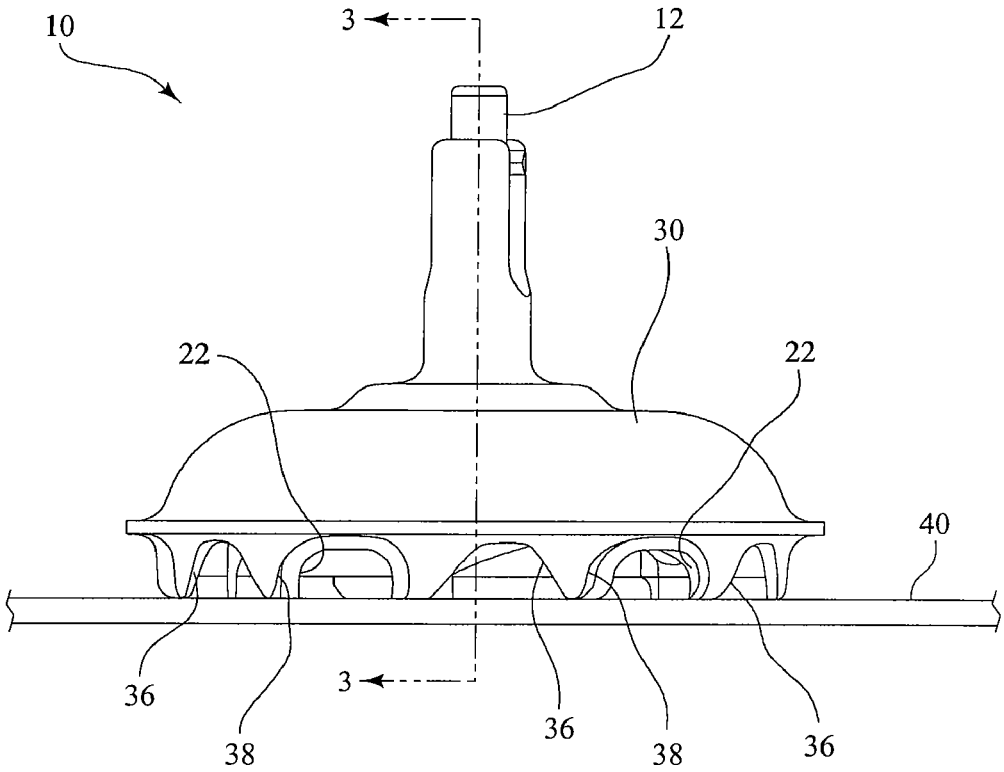
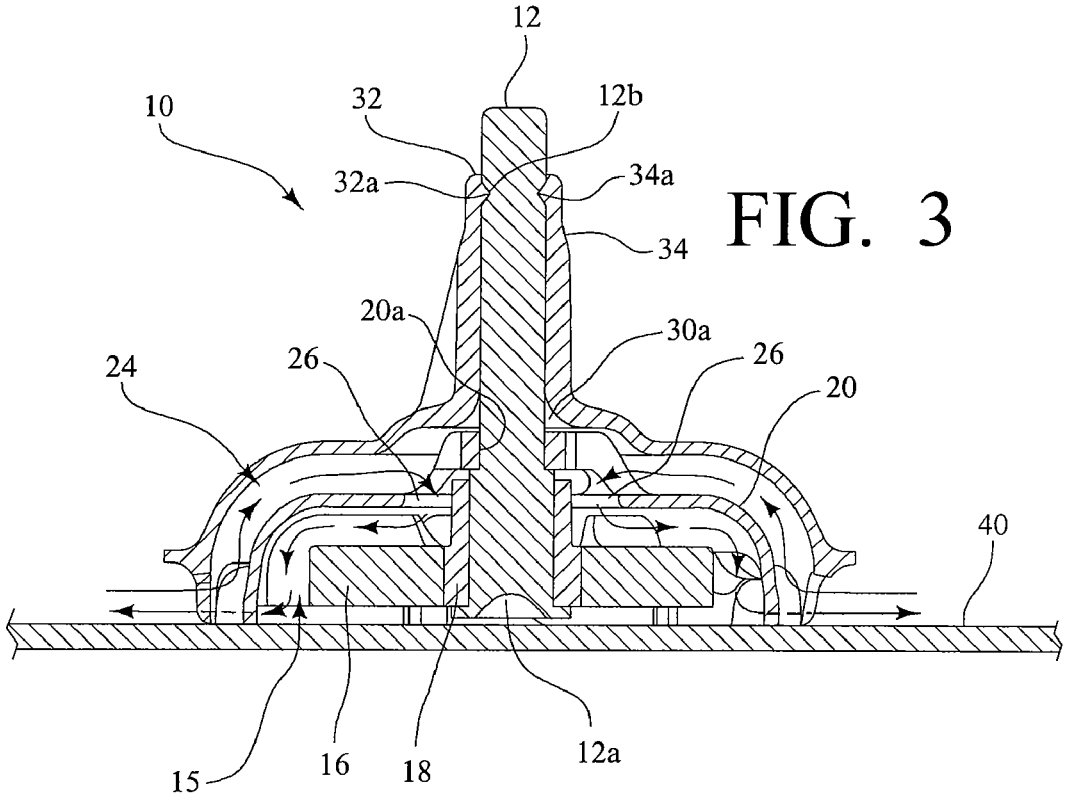
FIG. 3

PUMP ASSEMBLY FOR CHILLED BEVERAGE DISPENSER

CROSS-REFERENCE TO RELATED APPLICATIONS

The present application claims priority to U.S. Provisional Patent Application Ser. No. 60/718,467 filed on Sep. 19, 2005, the entire disclosure of which is incorporated herein by reference.

BACKGROUND OF THE INVENTION

The present invention relates to beverage dispensers for cooling a beverage to an acceptable temperature for consumption. In this regard, there are various distinct types of chilled beverage dispensers in the industry. Each, however, requires some sort of cooling system, typically a source of a cooling medium (such as a compressor and pump), a heat exchanger, and connecting tubing between the heat exchanger and cooling medium source. The heat exchanger itself is generally in contact with the beverage or the bowl containing the beverage. For example, one common type of dispenser incorporates a heat exchanger consisting of one or more continuous sinuous tubes submerged within the beverage in the dispenser bowl. The tubes form a heat exchanger bank that carries the cooling medium. The beverage is caused to circulate about the bank, allowing its heat to be transferred across the walls of the tubing to the flowing cooling medium. However, in such a dispenser, there must be a hole or opening through the bottom wall of the dispenser bowl to allow the tubes submerged in the beverage to be in fluid communication with the compressor and pump. Furthermore, such a construction creates a sanitation problem as the internal surfaces of the bowls and the heat exchanger bank must be cleaned with regularity, and the very shape of the heat exchanger bank poses a significant challenge to cleaning.

Therefore, alternative dispenser constructions have attempted to avoid the sanitation problem by creating a "holeless" dispenser bowl, in which the heat exchanger abuts an external surface of the bowl, commonly, the bottom wall of the bowl. Accordingly, the bottom wall of the bowl acts as an intermediary heat conductor and transfers the heat from the beverage to the flowing cooling medium of the heat exchanger.

As an alternative, co-pending and commonly assigned U.S. patent application Ser. No. 11/194,213, which is incorporated herein by this reference, describes a chilled beverage dispenser that has a "holeless" bowl and uses a cradle evaporator to achieve cooling of the beverage. Such a chilled beverage dispenser can generally be characterized as having an upper portion and a lower portion. The upper portion has a support chassis, which includes walls that collectively define a compartment for housing a dispenser bowl and a cradle evaporator. The lower portion includes a frame that defines a compartment for housing various cooling components for providing the necessary cooling medium to the cradle evaporator.

The cradle evaporator comprises three panels—a bottom panel and two side panels, the side panels being bolted or similarly fastened to the edges of the bottom panel in a substantially perpendicular orientation relative to the bottom panel, recognizing that there may be a slight draft or taper to accommodate insertion and removal of the dispenser bowl. The bottom and side panels each define a continuous and sinuous channel, which carries a cooling medium. For example, the panels may be constructed of die-cast aluminum with cast-in copper evaporator coils.

The dispenser bowl is preferably constructed of a thin-walled plastic, such that heat transfer can be achieved through the bottom and side walls of the dispenser bowl. Specifically, the bottom panel of the cradle evaporator has substantially the same size and shape and is co-extensive with the bottom wall of the dispenser bowl. Furthermore, the side panels are in contact with the side walls of the dispenser bowl over a substantial portion of the surface of each side wall.

As the cooling medium enters the cradle evaporator, it first enters the continuous and sinuous channel of the bottom panel, such that initial heat absorption is through the bottom wall of the dispenser bowl. As it completes travel through the channel of the bottom panel, the path of the cooling medium is split and directed to each of the continuous and sinuous channels of the side panels. This provides for the absorption of heat along the side walls of the dispenser bowl. Accordingly, the aforementioned sanitation problems are addressed as there is a "holeless" dispenser bowl, which can readily be lifted away from the remainder of the dispenser for cleaning. At the same time, there is no sacrifice of the effectiveness and efficiency of the cooling of the beverage because heat transfer occurs not only through the bottom wall of the dispenser bowl, but also through portions of the side walls of the dispenser bowl.

Regardless of the particular construction details and cooling techniques employed, when the dispenser includes a "holeless" bowl, there must be some consideration given as to how to appropriately agitate the beverage stored within the dispenser bowl. Specifically, in beverage dispensing equipment, a bladed impeller is commonly used to agitate, mix or pump the stored beverage. To avoid the need for a hole or opening through the bottom wall of the dispenser bowl, the bladed impeller is normally positioned within the dispenser bowl and then magnetically coupled to a rotating magnet (driven by motor) exterior to the bowl. For examples of common uses of such a magnetic impeller, reference is made to U.S. Pat. Nos. 5,931,343 and 5,209,069, each of which is assigned to the present applicant and is incorporated herein by this reference.

However, it is recognized that such impellers often draw air into the stored beverage, thus creating a vortex (i.e., turbulent flow conditions) and undesirable foaming of the beverage, especially when the stored beverage is at a low level within the dispenser bowl. Therefore, there remains a need for a pump assembly for a chilled beverage dispenser that minimizes turbulent and undesirable foaming of the beverage, while still ensuring that the beverage is effectively agitated.

SUMMARY OF THE INVENTION

The present invention is a pump assembly for a chilled beverage dispenser, including a bladed impeller positioned within the dispenser bowl that is magnetically coupled to and driven by a rotating magnet exterior to the bowl. Furthermore, the pump assembly has a design and construction that minimizes turbulent and undesirable foaming of the beverage.

An exemplary pump assembly made in accordance with the present invention includes an axle; a bladed impeller which rotates about a substantially vertical axis defined by the axle; an inner pump shell; and an outer pump shell. The impeller is coupled to the axle, and the inner pump shell is then fit over the axle, with the axle extending upwardly and through a central opening defined through the top of the inner pump shell. In this regard, the inner pump shell is a generally dome-shaped structure that defines an internal cavity for enclosing the impeller without impeding rotation of the impeller. Also, the inner pump shell defines multiple openings along its bottom edge for outflow of beverage from the pump assembly.

The outer pump shell, which also is a generally dome-shaped structure, then fits over and engages the lower pump shell, with a cavity being maintained between the inner pump shell and the outer pump shell. The outer pump shell also defines one set of openings along its bottom edge that facilitate inflow of beverage into the pump assembly, and an additional set of openings that facilitate outflow of beverage from the pump assembly. These two types of openings alternate along the circumference of the outer pump shell, with the openings that facilitate inflow of beverage being positioned between the openings defined along the bottom edge of the inner pump shell, and the openings that facilitate outflow of beverage being in registry with the openings defined along the bottom edge of the inner pump shell.

In general, the pump assembly is thus designed to draw beverage in at the bottom (i.e., along the bottom wall surface of the dispenser bowl), and also to discharge from the bottom, thus providing maximum agitation of the beverage. As the bladed impeller rotates, beverage is drawn through the openings defined by the outer pump shell and into the cavity defined between the inner pump shell and the outer pump shell. As it is drawn into the cavity, the beverage flows upwardly over the inner pump shell, spiraling toward the top of the inner pump shell. As the beverage reaches the top of the inner pump shell, it is drawn downwardly through openings defined through the top of the inner pump shell. The beverage is then moved through the cavity between the inner pump shell and the impeller by the rotation of the impeller, eventually being discharged through the openings defined along the bottom edge of the inner pump shell and a corresponding opening defined along the bottom edge of the outer pump shell. Again, the openings defined along the bottom edge of the outer pump shell that facilitate outflow of beverage from the pump assembly are in registry with the openings defined along the bottom edge of the inner pump shell.

Thus, the inner and outer pump shells of the pump assembly effectively separate the inlet and outlet (or discharge) streams, even though both inflow and outflow occurs along the bottom wall surface of the dispenser bowl.

DESCRIPTION OF THE DRAWINGS

FIG. 2 is a side view of the pump assembly of FIG. 1;

FIG. 3 is a sectional view of the pump assembly of FIG. 1 taken along line 3-3 of FIG. 2;

DETAILED DESCRIPTION OF THE INVENTION

The present invention is a pump assembly for a chilled beverage dispenser, including a bladed impeller positioned within the dispenser bowl that is magnetically coupled to and driven by a rotating magnet exterior to the bowl. Furthermore, the pump assembly has a design and construction that minimizes turbulent and undesirable foaming of the beverage.

Figure 1:
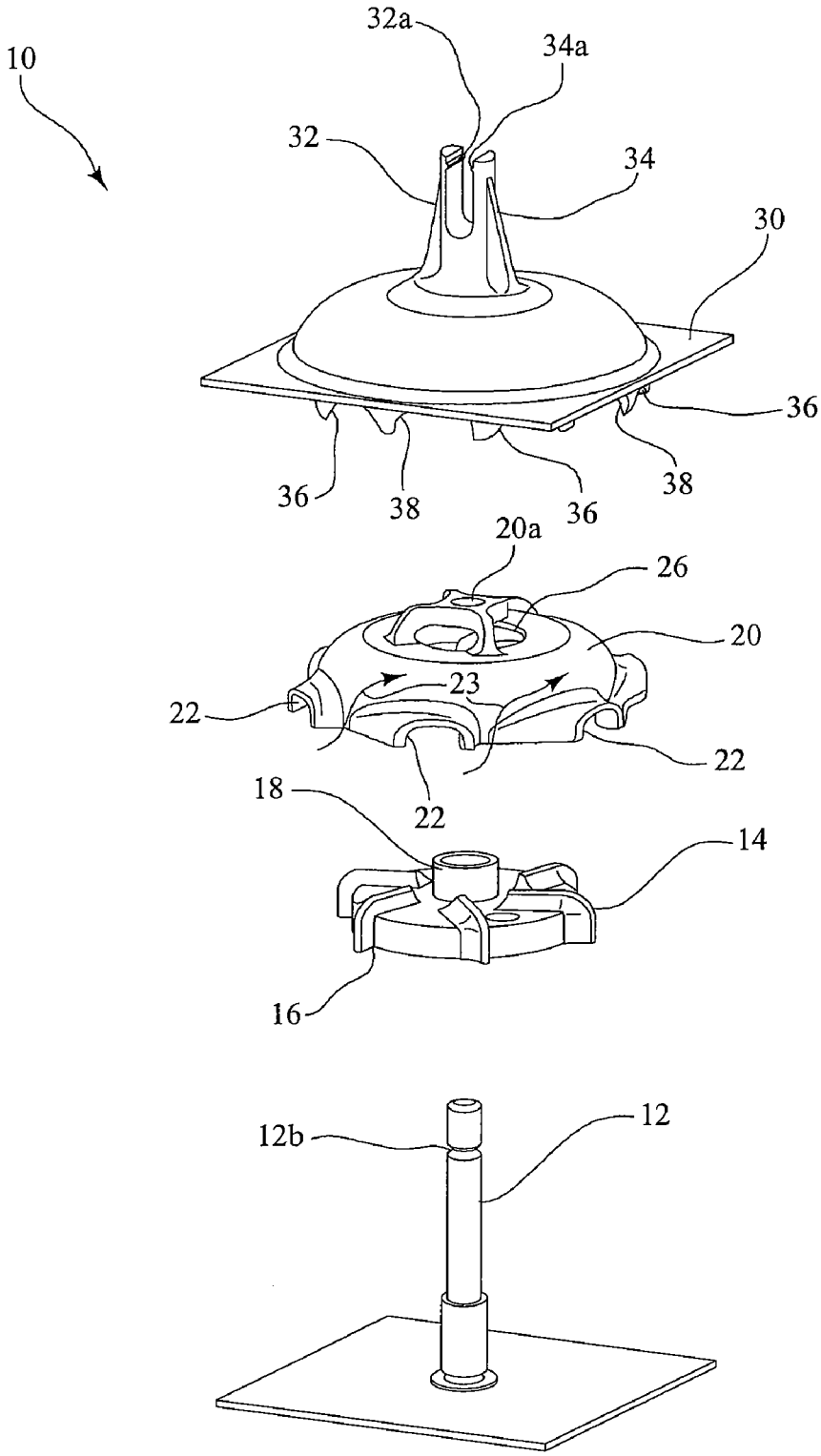
FIG. 1 is an exploded perspective view of an exemplary pump assembly made in accordance with the present invention.

FIG. 1 is an exploded perspective view of an exemplary pump assembly 10 made in accordance with the present invention; FIG. 2 is side view of the assembled pump assembly 10; and FIG. 3 is a sectional view of the exemplary pump assembly 10 taken along line 3-3 of FIG. 2. As illustrated in FIGS. 1-3, the exemplary pump assembly 10 includes an axle 12; a bladed impeller 14 which rotates about a substantially vertical axis defined by the axle 12; an inner pump shell 20; and an outer pump shell 30.

The impeller 14 is generally comprised of a magnetic disk 16 and a bearing sleeve 18. The axle 12 passes through the bearing sleeve 18, securing the impeller 14 to the axle 12. The bearing sleeve 18 is preferably constructed of a food-grade polymer material that complies with NSF International Standard 51. For example, preferred polymer materials for the axial bearing sleeve 18 include: Celenase® 1500-2 (FDA) NF2004, a glass-reinforced nylon distributed by Ticona of Summit, N.J.; and Thermocomp® 1F-1006 LE YL3-065-1, another glass-reinforced nylon that is distributed by LNP Engineering Plastics, Inc. of Exton, Pa. The magnetic disk 16 has an annular construction and is molded or otherwise fit around the axial bearing sleeve 18, with the magnetic disk 16 having an appropriate geometry for the impeller function, in this example, with appropriate blades for agitating the stored beverage and facilitating the pumping function, as further described below. Furthermore, the magnetic disk 16 must also be composed of a food-grade material, such as a hard ferrite/isotropic neodymium FN618 distributed by Aircom Manufacturing, Inc. of Indianapolis, Ind.

With the impeller 14 coupled to the axle 12, the inner pump shell 20 is then fit over the axle 12, with the axle 12 extending upwardly and through a central opening 20*a* defined through the top of the inner pump shell 20. In this regard, the inner pump shell 20 is a generally dome-shaped structure that defines an internal cavity 15 for enclosing the impeller 14 without impeding rotation of the impeller 14. Also, as best illustrated in FIG. 1, the inner pump shell 20 defines six openings (generally indicated by reference numeral 22) along its bottom edge. Beverage flows from the pump assembly 10 out of these openings 22, as further described below The outer pump shell 30, which also has a generally dome-shaped structure, then fits over and engages the lower pump shell 20, with a cavity 24 being maintained between the inner pump shell 20 and outer pump shell 30, as further described below. Furthermore, in this exemplary embodiment, a snap-fit detent arrangement is used to retain the axle 12 relative to the outer pump shell 30. Specifically, the outer pump shell 30 includes two substantially vertical extensions 32, 34 positioned on either side of a central opening 30*a* defined through the top of the outer pump shell 30. Each of these vertical extensions 32, 34 has a horizontally projecting detent 32*a*, 34*a* near its distal end that is designed to engage a circumferential groove 12*b* in the upper portion of the axle 12. Thus, as the outer pump shell 30 is fit over the axle 12, the vertical extensions 32, 34 flex outwardly until the detents 32*a*, 34*a* "snap" into the circumferential groove 12*b* in the upper portion of the axle 12. Perhaps more importantly, and as best illustrated in FIGS. 1 and 2, the outer pump shell 30 defines a first set of six openings (generally indicated by reference numeral 36) along its bottom edge that facilitate inflow of beverage into the pump assembly 10, and a second set of six additional openings (generally indicated by reference numeral 38) that facilitate outflow of beverage from the pump assembly 10. These two types of openings 36, 38 alternate along the circumference of the outer pump shell 30, with the openings 36 that facilitate inflow of beverage being positioned between the openings 22 defined along the bottom edge of the inner pump shell 20, and the openings 38 that facilitate outflow of beverage being in registry with the openings 22 defined along the bottom edge of the inner pump shell 20.

Figure 4:
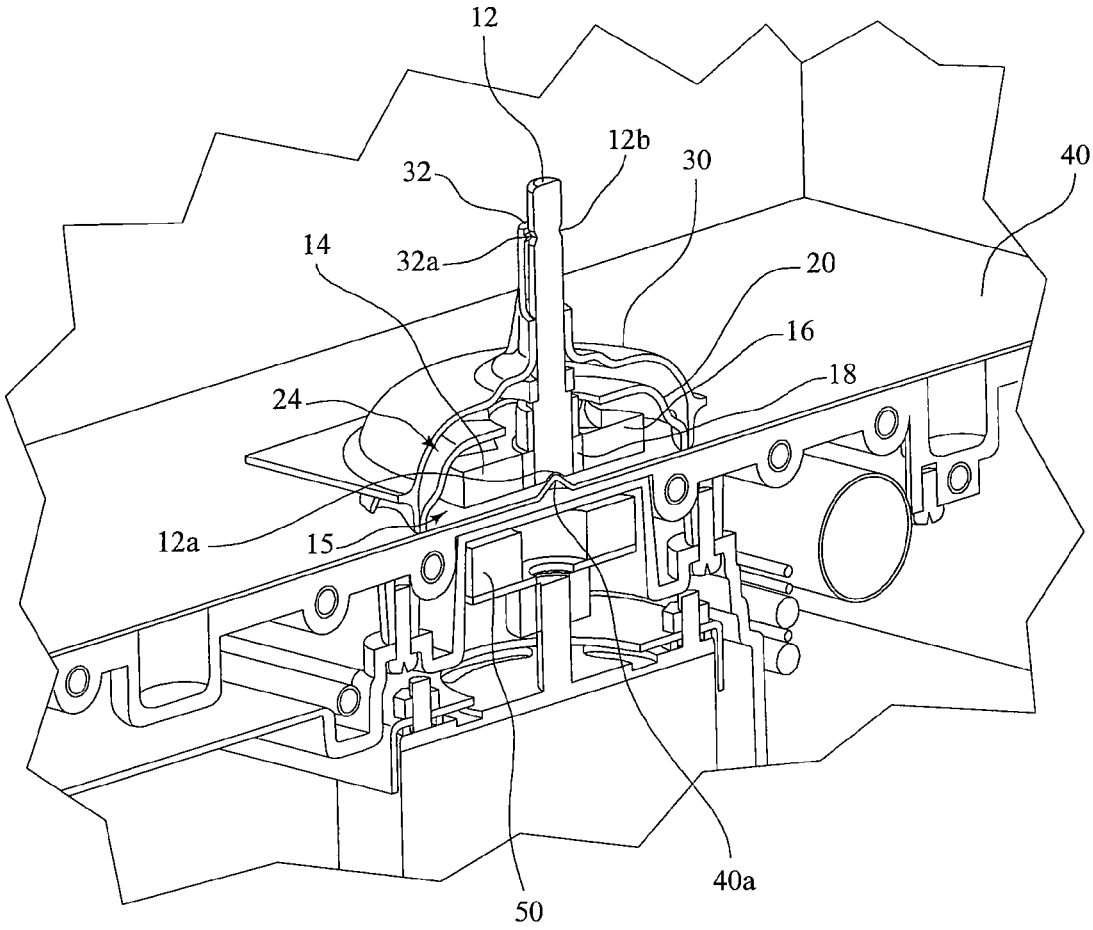
FIG. 4 is a sectional view of the pump assembly of FIG. 1 as installed in a chilled beverage dispenser.

FIG. 4 is a sectional view of the exemplary pump assembly 10 as installed in a chilled beverage dispenser. As shown, in this exemplary embodiment, the axle 12 defines a conical recess 12*a* in the lower surface thereof, with the dispenser bowl 40 including a corresponding conical protrusion 40*a* along its bottom wall surface. Accordingly, the axle 12 is appropriately positioned with this conical protrusion 40*a* being received in the conical recess 12*a* defined by the axle 12. Then, the above-described snap-fit detent arrangement holds the assembly 10 together, with the magnetic coupling between the impeller 12 and a rotating magnet 50 exterior to the dispenser bowl 40 holding the assembly 10 in position against the bottom wall surface of the dispenser bowl 40.

Figure 5:
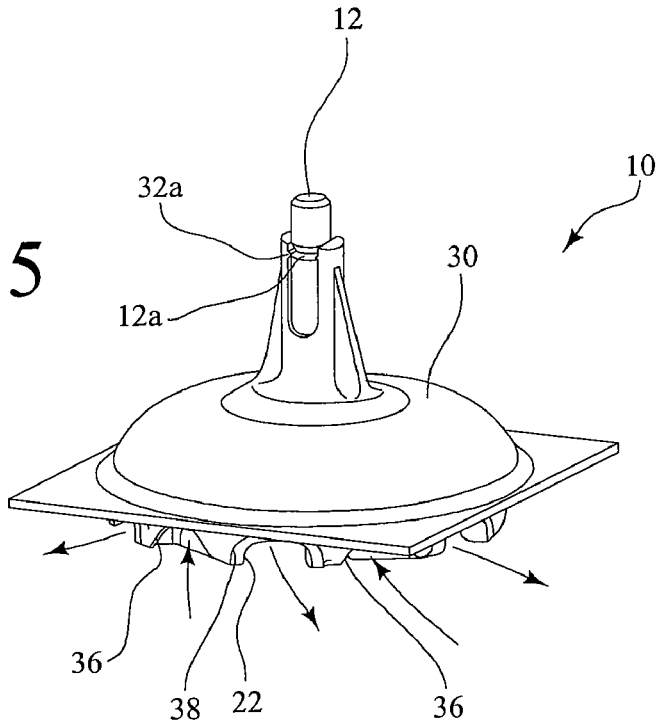
FIG. 5 is a side perspective view of the pump assembly of FIG. 1, illustrating the inflow and outflow of beverage through the pump assembly.
Figure 6:
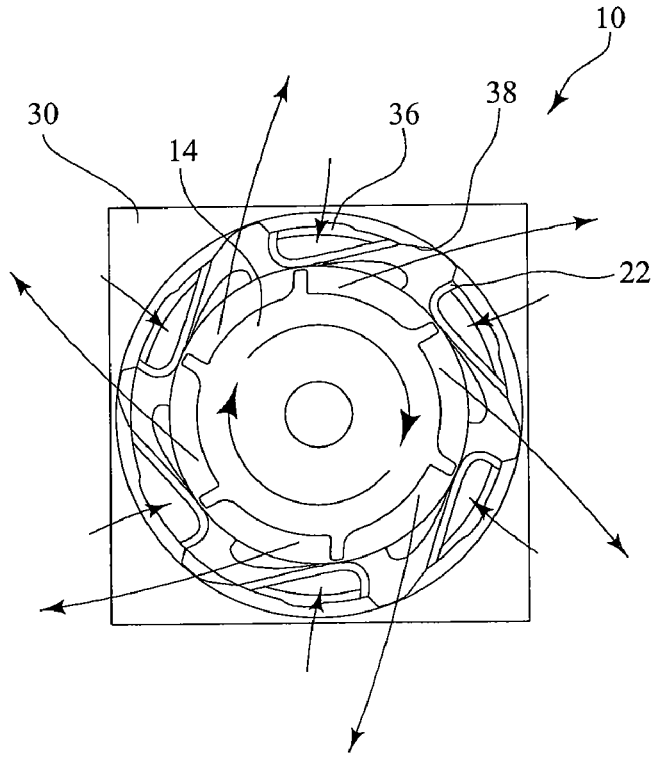
FIG. 6 is a bottom view of the pump assembly of FIG. 1, illustrating the inflow and outflow of beverage through the pump assembly.

FIGS. 5-6 are further views of the pump assembly 10, that along with FIG. 2, illustrate the inflow and outflow of beverage through the pump assembly 10. In general, the pump assembly 10 is designed to draw beverage in at the bottom (i.e., along the bottom wall surface of the dispenser bowl 40), and also to discharge from the bottom, thus providing maximum agitation of the beverage. In this regard, and as mentioned above, the outer pump shell 30 defines six openings 36 that facilitate inflow of beverage and are positioned between the openings 22 defined along the bottom edge of the inner pump shell 20, and further defines six openings 38 that facilitate outflow of beverage and are in registry with the openings 22 defined along the bottom edge of the inner pump shell 20. As such, as the bladed impeller 14 rotates, beverage is drawn through the openings 36 defined by the outer pump shell 30 and into the cavity 24 defined between the inner pump shell 20 and the outer pump shell 22. As it is drawn into the cavity 24, the beverage flows upwardly over the inner pump shell 20. Furthermore, and as generally illustrated by arrow 23 in FIG. 1, the beverage is moving in a counterclockwise rotation along the upper surface of the inner pump shell 20, spiraling toward the top of the inner pump shell 20. In this regard, it should be noted that the structure along the bottom edge of the inner pump shell 20 that defines the openings 22 also serves as a guide for introducing the beverage into the cavity 24 with such a spiraling movement.

Referring still to FIGS. 2 and 5-6, as the beverage reaches the top of the inner pump shell 20, it is drawn downwardly through openings 26 defined through the top of the inner pump shell 20. The beverage is then moved through the cavity 15 between the inner pump shell 20 and the impeller 14 by the rotation of the impeller 14, eventually being discharged through the openings 22 defined along the bottom edge of the inner pump shell 20 and a corresponding opening 38 defined along the bottom edge of the outer pump shell 30. Again, the openings 38 defined along the bottom edge of the outer pump shell 30 that facilitate outflow of beverage from the pump assembly 10 are in registry with the openings 22 defined along the bottom edge of the inner pump shell 20.

Thus, the inner and outer pump shells 20, 30 of the pump assembly 10 effectively separate the inlet and outlet (or discharge) streams, even though both inflow and outflow occurs along the bottom wall surface of the dispenser bowl 40. As mentioned above, because of this construction, maximum agitation of the beverage is achieved as the discharge streams are directed radially from the pump assembly 10 and impinge on the bottom wall surface of the dispenser bowl 40. Furthermore, this construction minimizes the possibility of the impeller drawing air into the pump assembly 10 and creating undesirable foaming of the beverage, especially when the stored beverage is at a low level within the dispenser bowl 40.

One of ordinary skill in the art will recognize that additional embodiments are possible without departing from the teachings of the present invention. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A pump assembly for a chilled beverage dispenser including a dispenser bowl for storing a beverage, comprising:

an axle being oriented in a substantially vertical orientation at a predetermined location along a bottom wall surface of the dispenser bowl;

an impeller which rotates about an axis defined by the axle;

an inner pump shell that defines an internal cavity for enclosing the impeller without impeding rotation of the impeller; and an outer pump shell that fits over and engages the inner pump shell, with a cavity being defined and maintained between the inner pump shell and the outer pump shell;

wherein rotation of said impeller draws the beverage into said pump assembly along the bottom wall surface of the dispenser bowl, and further discharges the beverage from said pump assembly along the bottom wall surface of the dispenser bowl.

2. The pump assembly as recited in claim 1, wherein the rotation of said impeller initially draws the beverage through one or more openings defined by the outer pump shell and into the cavity defined and maintained between the inner pump shell and the outer pump shell.

3. The pump assembly as recited in claim 2, wherein after being drawn into the cavity defined and maintained between the inner pump shell and the outer pump shell, the beverage flows upwardly over the inner pump shell, spiraling toward the top of the inner pump shell, where it is then drawn downwardly through one or more openings defined through the top of the inner pump shell into the internal cavity defined by the inner pump shell and enclosing the impeller.

4. The pump assembly as recited in claim 3, wherein after being drawn into the internal cavity defined by the inner pump shell and enclosing the impeller, the beverage is discharged through one or more openings defined along a bottom edge of the inner pump shell and the one or more openings defined by the outer pump shell.

5. The pump assembly as recited in claim 1, wherein said impeller is a bladed impeller.

6. The pump assembly as recited in claim 1, wherein said impeller is magnetically coupled to and driven by a rotating magnet exterior to the dispenser bowl.

7. The pump assembly as recited in claim 6, wherein said impeller comprises a magnetic disk and a bearing sleeve, said axle passing through said bearing sleeve.

8. The pump assembly as recited in claim 1, wherein the inner pump shell is a generally dome-shaped structure that fits over said axle, with said axle extending upwardly and through a central opening defined through the top of the inner pump shell.

9. The pump assembly as recited in claim 8, wherein the outer pump shell is a generally dome-shaped structure that fits over and engages the inner pump shell.

10. A pump assembly for a chilled beverage dispenser including a dispenser bowl for storing a beverage, comprising:

an axle being oriented in a substantially vertical orientation at a predetermined location along a bottom wall surface of the dispenser bowl;

an impeller which rotates about an axis defined by the axle;

an inner pump shell that defines an internal cavity for enclosing the impeller without impeding rotation of the impeller, the inner pump shell defining multiple openings along its bottom edge; and an outer pump shell that fits over and engages the inner pump shell to define and maintain a cavity between the inner pump shell and the outer pump shell, the outer pump shell defining a first set of multiple openings along its bottom edge that facilitate inflow of beverage into the pump assembly, and a second set of multiple openings that facilitate outflow of beverage from the pump assembly, said second set of multiple openings being in registry with the multiple openings defined along the bottom edge of the inner pump shell;

wherein rotation of said impeller causes the beverage to be drawn into said pump assembly through said first set of openings defined by the outer pump shell along the bottom wall surface of the dispenser bowl, and then discharged through the multiple openings defined by the inner pump shell and said second set of multiple openings defined by the outer pump shell along the bottom wall surface of the dispenser bowl.

11. The pump assembly as recited in claim 10, wherein the rotation of said impeller initially draws the beverage through said first set of openings defined by the outer pump shell and into the cavity defined and maintained between the inner pump shell and the outer pump shell.

12. The pump assembly as recited in claim 11, wherein after being drawn into the cavity defined and maintained between the inner pump shell and the outer pump shell, the beverage flows upwardly over the inner pump shell, spiraling toward the top of the inner pump shell, where it is then drawn downwardly through one or more openings defined through the top of the inner pump shell into the internal cavity defined by the inner pump shell and enclosing the impeller.

13. The pump assembly as recited in claim 12, wherein after being drawn into the internal cavity defined by the inner pump shell and enclosing the impeller, the beverage is discharged through the multiple openings defined by the inner pump shell and said second set of multiple openings defined by the outer pump shell along the bottom wall surface of the dispenser bowl.

14. The pump assembly as recited in claim 10, wherein said impeller is a bladed impeller.

15. The pump assembly as recited in claim 10, wherein said impeller is magnetically coupled to and driven by a rotating magnet exterior to the dispenser bowl.

16. The pump assembly as recited in claim 15, wherein said impeller comprises a magnetic disk and a bearing sleeve, said axle passing through said bearing sleeve.

17. The pump assembly as recited in claim 10, wherein the inner pump shell is a generally dome-shaped structure that fits over said axle, with said axle extending upwardly and through a central opening defined through the top of the inner pump shell.

18. The pump assembly as recited in claim 17, wherein the outer pump shell is a generally dome-shaped structure that fits over and engages the inner pump shell.

* * * * *